US006568032B1

(12) United States Patent
Ramsauer

(10) Patent No.: US 6,568,032 B1
(45) Date of Patent: May 27, 2003

(54) SCREW-ON HINGE WITH BLOCKED POSITION

(76) Inventor: Dieter Ramsauer, Am Neuhauskothen 20, D-42555 Velbert (DE)

( * ) Notice: Subject to any disclaimer, the term of this patent is extended or adjusted under 35 U.S.C. 154(b) by 0 days.

(21) Appl. No.: 09/786,221

(22) PCT Filed: Aug. 17, 1999

(86) PCT No.: PCT/EP99/06023

§ 371 (c)(1),
(2), (4) Date: May 7, 2001

(87) PCT Pub. No.: WO00/14371

PCT Pub. Date: Mar. 16, 2000

(51) Int. Cl.[7] ..... E05D 11/10
(52) U.S. Cl. ..... 16/329; 16/330
(58) Field of Search ..... 16/329, 328, 330, 16/303, 334, 386; 403/97, 96, 91

(56) References Cited

U.S. PATENT DOCUMENTS

| | | | | | |
|---|---|---|---|---|---|
| 294,746 | A | * | 3/1884 | Straup et al. | 16/330 |
| 769,035 | A | * | 8/1904 | Walter | 16/330 |
| 975,097 | A | * | 11/1910 | Wright | 16/330 |
| 1,078,002 | A | * | 11/1913 | Schrey | 16/330 |
| 1,440,713 | A | * | 1/1923 | Ausbourne | 16/324 |
| 1,465,912 | A | * | 8/1923 | Jensen | 16/330 |
| 1,946,837 | A | * | 2/1934 | Clayton | 16/330 |
| 2,097,651 | A | * | 11/1937 | Stangeland | 16/330 |
| 2,182,546 | A | | 12/1939 | Raymond | |
| 5,317,785 | A | * | 6/1994 | Kobayashi | 16/322 |
| 5,412,842 | A | | 5/1995 | Riblett | |
| 5,715,576 | A | * | 2/1998 | Liu | 16/303 |
| 5,774,938 | A | * | 7/1998 | Kent et al. | 16/330 |

FOREIGN PATENT DOCUMENTS

| | | |
|---|---|---|
| DE | 2 235 555 | 1/1974 |
| DE | 2 342 945 | 3/1974 |
| DE | 24 18 147 | 11/1975 |
| DE | 29 41 860 | 4/1980 |
| DE | 31 26 933 | 5/1982 |
| DE | 36 24 649 | 2/1988 |
| DE | 39 05 351 | 8/1990 |
| DE | 297 09 777 | 9/1997 |
| DE | 196 19 473 | 11/1997 |
| EP | 0 266 490 | 5/1988 |

* cited by examiner

*Primary Examiner*—Chuck Y. Mah
(74) *Attorney, Agent, or Firm*—Reed Smith LLP

(57) ABSTRACT

A screw-on hinge is disclosed for a door or flap which is arranged so as to be swivelable vertically or horizontally at a frame or wall, wherein the door or flap is held in releasable manner in at least one swivel angle position (−5°; +85°; +175°). This screw-on hinge comprises a first hinge part which can be fastened, for example, to the frame, and a second hinge part which can be fastened, for example, to the door or flap. Each of the hinge parts is symmetric with respect to its center bisecting line and comprises a bore hole for receiving a hinge pin arrangement. The hinge pin arrangement comprises a sleeve which is connected with one hinge part so as to be rigid with respect to rotation, and a springing catch device is arranged between the sleeve and the other hinge part. The hinge pin device comprises two parts, and one end of one hinge part which faces the other hinge part forms the catch device, and the catch device is formed by an end face of the sleeve and comprises a helical pressure spring arranged axially inside the sleeve.

19 Claims, 2 Drawing Sheets

SCREW-ON HINGE WITH BLOCKED POSITION

BACKGROUND OF THE INVENTION a) Field of the Invention

The invention is directed to a screw-on hinge for a door or flap which is arranged so as to be swivelable vertically or horizontally at a frame or wall, wherein the door or flap is held in releasable manner in at least one swivel angle position, this screw-on hinge comprising a first hinge part which can be fastened, for example, to the frame, and a second hinge part which can be fastened, for example, to the door or flap, each of which hinge parts is symmetric with respect to its center bisecting line and comprises a bore hole for receiving a hinge pin arrangement, wherein the hinge pin arrangement comprises a sleeve which is connected with one hinge part so as to be fixed with respect to rotation, and a springing catch device is arranged between the sleeve and the other hinge part.

b) Description of the Related Art

A screw-on hinge of the type mentioned above is described in U.S. Pat. No. 5,412,842. The known hinge makes it possible to hold a door in releasable manner at a predetermined position relative to the frame when the door is swiveled for the purpose of opening or closing. In the known arrangement, the sleeve is provided with recessed radial bore holes into which spring-loaded balls can run. When the balls run in, the sleeve and therefore the hinge part (hinge tabs) connected with this sleeve and therefore also the door are held in the corresponding position with a force which depends on the spring tension and run-up angle of the balls. Bore hole spaces which are oriented radial to the hinge axis are provided in one hinge part for receiving the spring. These bore hole spaces are open at one end toward the sleeve and receive the balls, while the other end of the bore hole can be closed by a slide at which the pressure spring is supported. This is disadvantageous in that it requires a special construction of the at least one hinge part (hinge tab); this special construction leads to an increase in the structural height of the hinge part. There are also relatively many structural component parts. In the embodiment form shown in the reference, there is a total of three balls, three pressure springs and an insertable holding plate which are necessary for achieving the desired result. Difficulties also arise with respect to assembly because the balls, pressure springs and plate cannot be mounted until the sleeve-shaped hinge pin which is provided with the run-in openings for the balls is in place within the two hinge parts. A further disadvantage with balls is the punctiform pressure point which leads to high area pressure and rapid material wear.

DE 29 41 860 A1 discloses a hinge comprising two hinge parts in which the hinge pin is formed by a sleeve in which is arranged a pressure spring which presses the end of the sleeve against an insert in order to achieve an elastic locking at certain rotational angles, wherein the end of the sleeve is provided with projections, the sleeve is connected with one hinge part so as to be rigid with respect to rotation and the insert is arranged in the other hinge part and is provided with radial notches. It is disadvantageous that the two hinge parts can not be fixed axially relative to one another and that the hinge can therefore be used only in connection with a second hinge of the same type that is constructed in the opposite sense (page 6, lines 16–21).

DE 24 18 147 discloses a hinge for a motor vehicle door with two hinge parts which are centered by a hinge pin and carry cooperating fitting surfaces. The fitting surfaces which are outfitted with notches and projections are pressed onto one another by the weight of the door or by springs (page 2, line 14), not described more fully, for fastening in an open position. One hinge part encloses the other in a fork-like manner.

DE 23 42 945 likewise describes a hinge for a motor vehicle door having a locking device. By means of a helical pressure spring 10 which can be reinforced by a second, coaxially arranged pressure spring 9, control plates which are provided with radial recesses and connected with one hinge part 3 so as to be rigid with respect to rotation are pressed against pins 11, 12 which are guided transversely through the hinge bolts 6 which are connected with the other hinge part 1 so as to be rigid with respect to rotation.

The hinge in EP 0 266 490 B1 (see FIG. 4) which is provided for a lockable vehicle door has two plate spring assemblies which are directed opposite to one another and held by a screw.

DE-OS 22 35 555 discloses hinge straps for a hinge with locking arrangement having (plate) springs which are disposed coaxially and arranged on the hinge pin (claim 2).

DE 31 26 933 A1 relates to a hinge strap for doors in which locking positions are possible. A holding force is caused by residual closing pressure (page 7, line 11).

DE 36 24 649 A1 mentions an upset bolt 4 and accordingly discloses the rivet principle for a fixable hinge for motor vehicles.

DE 39 05 351 A1 shows a folding door and also hinges with a catch device, wherein, according to column 2, lines 49–51, hinge parts and catch parts can also be injection molded from plastic and it is also possible for a bearing pin made of metal to be injection molded in plastic.

DE 196 19 473 A1 mentions a plastic slide in connection with a removable door hinge with a structurally combined door lock.

Most of the hinges known from the references mentioned above lack compactness, the spring devices are often also visible and not only have an unattractive appearance but also collect dust. Apart from U.S. Pat. No. 5,412,842 (and possibly DE 29 41 860 A1) which was mentioned above as the prior art coming closest, none of the references describes a hinge that is suitable for sheet metal cabinet doors.

OBJECT AND SUMMARY OF THE INVENTION

It is the primary object of the invention to avoid the above-mentioned disadvantages and to provide a screw-on hinge according to the type mentioned in the beginning which has a simpler construction, a more compact outer shape, fewer individual parts, is extensively symmetric and can therefore be mounted more easily and has a longer life.

This object is met in that the hinge pin device comprises two parts and in that one end of one hinge part which faces the other hinge part forms the catch device, and in that the catch device is formed by an end face of the sleeve and comprises a helical pressure spring arranged axially inside the sleeve.

This feature makes it possible to utilize the space of the hinge bolt for the catch device and the use of one of the screw-on hinge parts of the screw-on hinge for this purpose, which caused the problems described above, is avoided. In addition, the end face of the sleeve provides a contour surface which makes possible a catch device with relatively low area pressure which reduces material wear and prolongs the life of the hinge.

The symmetry of the hinge and its parts facilitates not only assembly but also subsequent modification of the fitting of the door.

According to a further development of the invention, the catch device comprises a shoulder or pocket hole bottom surface which is formed or arranged at the end of the bore hole for the hinge pin in the hinge part and in which are provided recesses or protuberances corresponding to protuberances or recesses of the end face of the sleeve, wherein the pressure spring presses the sleeve with its protuberances or recesses against the shoulder or bottom surface with its recesses and protuberances (recesses, projections). This is a particularly simple step for achieving the desired catch positions without using balls which can get lost and which, in addition, lead to difficulties when mounting the hinge.

For simplified production, it is advantageous when the non-rotational connection between one hinge part and the hinge pin is achieved by means of a tongue-in-groove arrangement or, alternately, by a non-circular cross-sectional shape, e.g., a prismatic shape, of the cross section of the hinge pin on one hand and of the bore hole in the hinge part in which this hinge pin is to be inserted on the other hand.

When the hinge pin has the shape of a sleeve, this is advantageous not only for economizing on material but also for facilitating the production of projections and recesses at the end face of this sleeve-shaped hinge pin. Moreover, there are special advantages to other embodiment forms to be described below such as the possibility of accommodating a helical pressure spring and screw bolt or rivet.

A hinge shape which is especially stable and simple at the same time is one in which one hinge part encloses the other hinge part in the manner of a fork as is also seen in the prior art. Particularly with this shape of hinge it is advantageous that the sleeve-shaped hinge pin is constructed in two parts and that the one end of one hinge pin part, which end faces the other hinge pin part, carries a catch device. In order to increase the locking force it is advantageous, according to another embodiment form of the invention, when catch projections or catch recesses are provided on the end faces of both hinge pin parts of the two-part hinge pin in a corresponding manner, which catch projections or catch recesses engage in corresponding recesses and projections formed by annular shoulders in the hinge part bore hole in which the corresponding ends of the hinge pin parts are received.

The other end of the hinge pin parts can then be received in the hinge pin bore hole of the other hinge part so as to be rigid with respect to rotation but possibly so as to slide in axial direction. Because it is held in a sliding manner, it is ensured that it can deflect in axial direction when locking or unlocking.

The spring arrangement for the catch device is also advantageously constructed in two parts; in particular, the ends of the spring facing away from each other can be held by a screw penetrating the spring parts, wherein one spring could be supported on the head of the screw and the other spring could be supported on a nut which is screwed onto the screw. This has the great advantage that the force with which the catch devices exert the holding force need not be absorbed by parts of the hinge so that these hinge parts are additionally loaded, but can be applied by the screws which do not otherwise exercise any holding function. This step greatly reinforces the stability of the entire arrangement. At the same time, the two fork prongs of the fork-shaped hinge part are relieved of bending forces.

It has proven advantageous when the end face of the sleeve has four projections (or raised portions) or recesses having a distance of 90 angular degrees from one another. This results in particularly favorable ratios for hinges enabling an opening angle of 180°. This arrangement enables a function in which there is locking in the closed position, in the position which is opened by 180° and at half of the opening angle at 90°. Further, this is a good compromise between the quantity of catch projections and the width of the projections, which leads to a good compromise between stability and holding force.

In this case, there should also be four recesses or projections formed by the shoulder and they should have a spacing of 90 angular degrees. Matching these projections and recesses to one another results in a particularly stable hinge shape and in a particularly high holding force in the different catch positions.

It is usually advantageous that the catch positions are oriented in such a way that a catch position is achieved just as the closing position of the door or flap is reached. Alternatively, however, the catch device can also be constructed in such a way that the spring pressure of the helical spring within a small angle of rotation extending around the catch point leads to a torque in the direction of the catch point and that the orientation of one catch point for the closing position is carried out in such a way that the catch point is not yet entirely reached when the door or flap is closed and, therefore, there is a torque acting in the closing direction. As a result of this, the door is held in its closing position with a certain pressure so that there is no flapping motion or play, as could happen when the door is in the closing position exactly at the zero point of the catch position.

Usually it is advantageous when the hinge parts are constructed in such a way that they can be screwed onto mutually flush fastening surfaces of the frame on one side and door or flap on the other side.

The invention will be described more fully in the following with reference to embodiment examples shown in the drawings.

DESCRIPTION OF THE PREFERRED EMBODIMENTS

Figure 1:
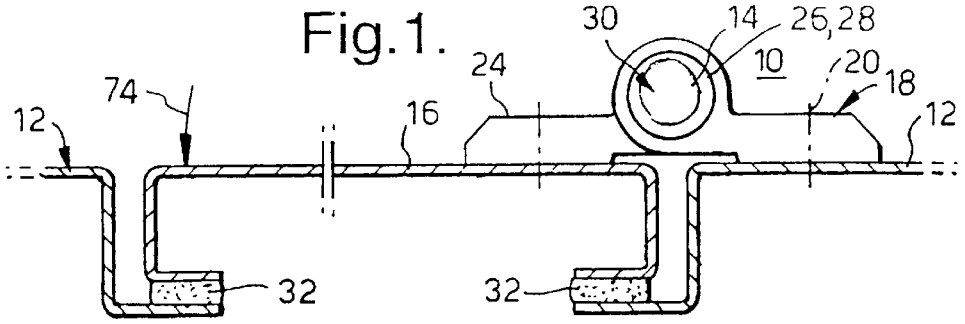
FIG. 1 is a cross-sectional view showing a thin wall with an opening which can be closed by a flap that is held at the thin wall by a hinge constructed according to the invention.
Figure 3:
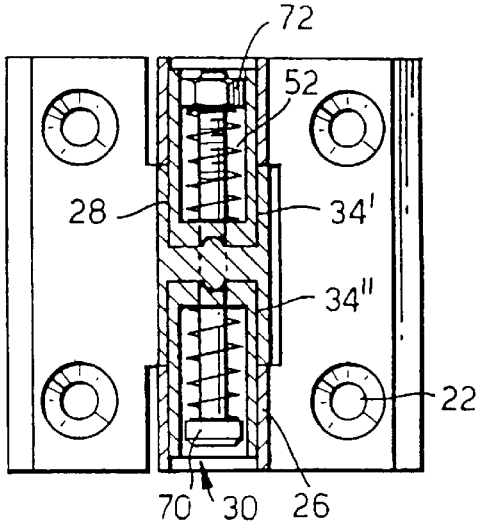
FIG. 3 shows a top view of the hinge with axial pin in section.
Figure 4:
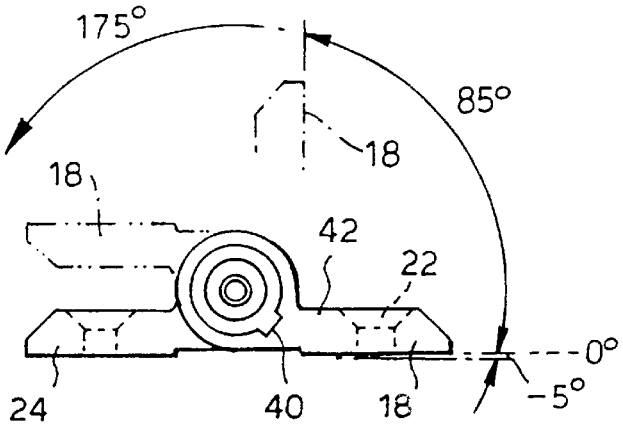
FIG. 4 shows a top view of the hinge of FIG. 3.
Figure 7:
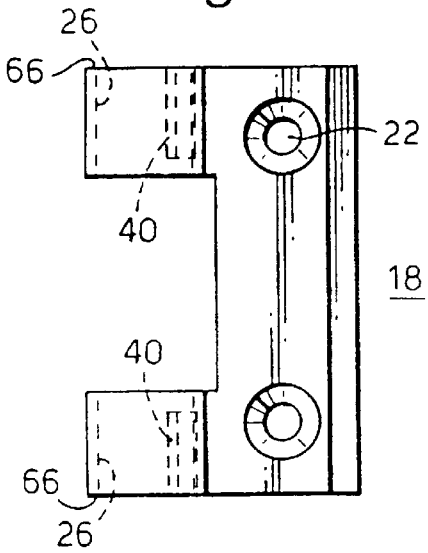
FIG. 7 shows a detailed view of one hinge part which encloses the hinge part shown in FIG. 9 by two fork prongs.
Figure 8:
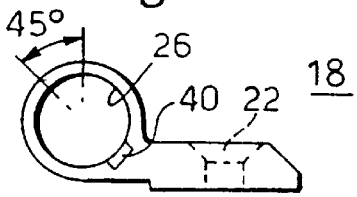
FIG. 8 shows a top view of the engaging hinge part shown in FIG. 7.

FIG. 1 shows a screw-on hinge 10 for a door or flap 16 which is arranged vertically or horizontally at a frame or wall 12 so as to be swivelable about a shaft 14 and which is held in releasable manner in at least one swiveling angle position, for example, in one of the positions shown in FIG. 4. The screw-on hinge 10 comprises a first hinge part 18 which can be fastened, for example, to the frame or to the wall 12, wherein the fastening could be carried out, for example, by means of two countersunk head screws 20 which are arranged so as to be axially offset (see corresponding countersunk head openings 22 in FIGS. 3 and 4). Corresponding bore holes are located in a second hinge part 24 which can be screwed to the door or flap 16, for example. Each of the hinge parts 18, 24 has a bore hole 26, 28 (see FIG. 7 or 9) in which a hinge pin device 30 can be received.

Figure 2:
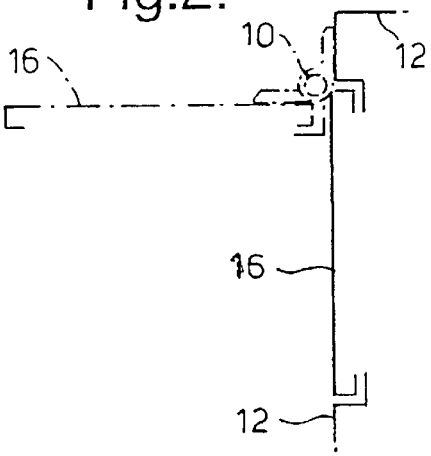
FIG. 2 shows a reduced view of the flap shown in FIG. 1 in a holding position which is open by 90 and which is locked in this position.

The ratios are shown again in a reduced view in FIG. 2, wherein the solid line shows the closed door or closed flap inside the wall or frame 12 and the dashed line shows another position swiveled by 90° relative thereto which can be a releasably held position. The arrangement according to FIG. 2 can be a machine casing 12 and the hinge 10 can hold a flap 16 which is swivelable about a horizontal axis; the flap 16 is closed in horizontal direction in the view shown in dashed lines and, for example, allows access to the machine space for maintenance purposes.

In contrast, FIG. 1 can represent a door 16 which can be opened and closed around a vertical shaft 14 and shows sealing strips 32 which are placed on bevels of the frame or wall 12 and, together with bevels in the door, make possible a tight closing of the openings that are closed off by the door 16 when the door 16 is closed.

In order to achieve this sealing effect reliably, it is important that a certain contact pressure is generated by the hinge 30; this is possible with the hinge arrangement according to the invention as will be described in the following.

Figure 11:
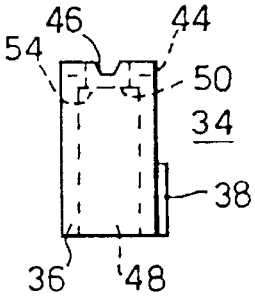
FIG. 11 shows a side view of a sleeve-like hinge pin part of a two-part hinge pin arrangement such as that used in FIG. 3.
Figure 12:
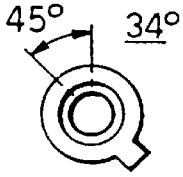
FIG. 12 shows a bottom view of the hinge pin part according to FIG. 11.
Figure 13:
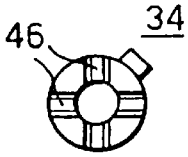
FIG. 13 shows a top view of the hinge pin part shown in FIG. 11.
Figure 14:
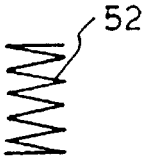
FIG. 14 shows a side view of the associated pressure spring which can be received in the sleeve-shaped hinge pin part.

According to FIG. 3, the hinge pin arrangement 30 is formed by two sleeve parts 34', 34" which are advisably constructed identically and are shown in a side view in FIG. 11, in a bottom view in FIG. 12 and in a top view in FIG. 13. At its lower end in FIG. 11, the sleeve part 34 has an axially oriented, radially projecting strip or spring 38 which can be received in a corresponding groove 40 arranged in the area of the hinge pin bore hole 26 formed by the first hinge part 18 in the area of the fastening tab 42. Accordingly, this groove 40 weakens the first hinge part only insignificantly because of this arrangement, wherein this tongue-in-groove connection serves to hold the sleeve 34 in the bore hole 26 of the two ends of the hinge part 18 so as to be rigid with respect to rotation but axially displaceable. The other end 44 has a circular end face in which are arranged four recesses 46 that are offset by 90°. The sleeve 34 forms an axial bore hole 48 which narrows to a bore hole 50 of smaller diameter near the end 44. A helical pressure spring 52, which is shown in FIG. 14 and which can be supported on the shoulder 54 formed by the narrowing to the bore hole 50, can be received in the bore hole 48 of larger diameter. A screw bolt 56 shown in FIG. 15 can be guided through the narrower bore hole 50 as will be described more fully below.

Figure 10:
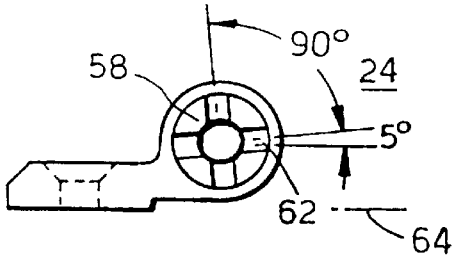
FIG. 10 shows a top view of the engaged hinge part according to FIG. 9.
Figure 9:
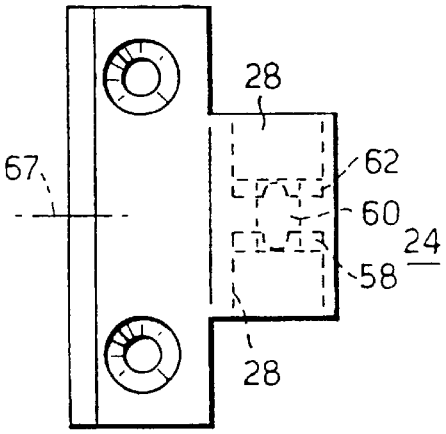
FIG. 9 shows a top view of the other, engaged hinge part.

The upper end of the sleeve 34 with the end face having the recesses 46 can be received in a bore hole 28 which is shown in FIG. 9 in relation to the second hinge part 24. This bore hole also forms a first bore hole area with larger diameter which can receive the sleeve 34 in a rotatable and axially displaceable manner and a second bore hole area 60 which forms an annular shoulder 58 and which has a smaller diameter that is sufficient to allow the shank of the bolt 56 to be guided through. As is shown in FIG. 10 in a bottom view of the part according to FIG. 9, the ring-shaped shoulder 58 has four axially protruding projections 62 which are arranged radially with respect to the hinge axis and are offset by 90 relative to one another, their 90 coordinates being oriented at a slight offset with respect to the fastening plane 64, namely, for example, by −5° as is made clear by the angles given in FIG. 10.

Figure 5:
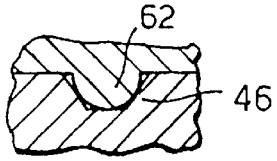
FIG. 5 shows an enlarged view of the locking area according to a first position (zero position)
Figure 6:
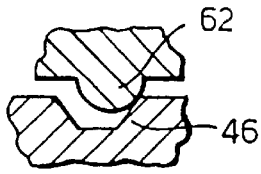
FIG. 6 shows the corresponding area in a second position (diverging from the zero position) for generating a torque in the closing direction.
Figure 15:
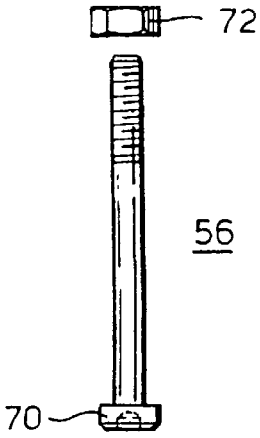
FIG. 15 shows a side view of the associated flat head screw with nut which compresses the springs of the two hinge pin parts.

The first hinge part 18 is constructed in such a way that it engages around the inner part 68 of the second hinge part 24 with its two legs 66, wherein, after corresponding alignment, the bore holes 26 of the two legs 66 of the first hinge part 18 are flush with the two bore holes 28 of the second hinge part 24 which are arranged symmetric to the middle of the hinge part 67. In this position, a sleeve part 34 can be inserted by its side 44 having the narrower bore hole 50 into the bore holes 26 of the first hinge part 18 from the outside until this side 44 has penetrated into and filled the bore hole 28 of the second hinge part 24, wherein the structural component part 34 with its spring part 38 is at the same time oriented in such a way that this spring 38 moves into the groove 40. This mounted position is shown in FIG. 3. Subsequently, a pressure spring 52 can be introduced into the two sleeves which open outward, whereupon, finally, the screw bolt 56 shown in FIG. 15 is guided, e.g., first through the lower pressure spring and accordingly through the bore hole 26 of the hinge part 18 and the (lower) bore hole 28 of the hinge part 24, subsequently through the bore hole 50 of the sleeve 34 arranged at bottom, then through the bore hole 60 of the hinge part 24, then through the bore hole 50 of a second sleeve part 34 which is inserted into the upper bore hole 28 of hinge part 24 in the opposite direction, through a second pressure spring 52 and accordingly through the bore hole 28 of the second hinge part and through the larger part of the bore hole 26 of the hinge part 18. In this position, the head 70 of the screw bolt 56 contacts the lower end of the lower pressure spring 52 shown in FIG. 3 and a nut 72 which is screwed to the upper thread of the screw bolt 56 forms a support for the upper end of the upper pressure spring 52 shown in FIG. 3. The flat head screw or screw bolt 56 preferably extends such that the two engaged pressure springs 52 are tensioned to a certain extent and the two sleeve parts 34' and 34" according to FIG. 3 accordingly move toward one another with their end faces having the recesses 46 and are therefore pressed onto the shoulders of the inner part 61 of the second hinge part 24, which shoulders have the projections 62. In the position which is displaced by 5°, for instance, as is shown in FIG. 10, the projection 62 and recess 46 match one another exactly as can be seen in FIG. 5 and the hinge has reached a catch position. This catch position is displaced by 5° in clockwise direction with respect to the hinge part 24 in the arrangement shown in FIG. 1, so that a certain pressure is exerted on the door leaf 16. Since the door frame does not allow this 5-degree displacement, the projection surface 62 according to FIG. 5 which is semicircular, for example, moves upward on a side surface of the trough-shaped offset 46, which side surface extends diagonally, for example, and accordingly increases the distance between the two structural component parts as can be seen in FIG. 6. This leads to a compression of the corresponding pressure spring 52. The pressure spring 52 tries to cancel this movement and presses the hinge part 24 in clockwise direction and therefore, according to FIG. 1, pushes the door into the closed position (see arrow 74).

Since this pressure or torque is generated by two springs 52, the contact pressure force is doubled.

The length of the flat head screw 56 is advisably selected in such a way that it vanishes inside the hinge parts. The hinge accordingly has an attractive appearance because the built-in catch device is not visible.

In the present embodiment form, a hinge according to FIG. 4 is constructed in such a way that it has catch points at –5, at 85 and at 175. At the –5-degree position, the frame or the wall presses the door into the 0-degree position and contact pressing pressure occurs. In the 85-degree position, the door stays in the open position and the door leaf projects away from the fastening surface essentially at right angles. Finally, there is another open position which has a catch point at 175, wherein the hinge shown here enables this large opening angle (see the dashed line in FIG. 4) because it is a 180-degree hinge.

The flat head screw 56 compressing the springs 52 makes it possible to adjust the pressing force and therefore the catching holding force by tightening or loosening the nut 72. If it is possible to dispense with this adjustability, a rivet of suitable length and with matching diameter can be used instead of the flat head screw 56, for example, in the form of a hollow rivet or compression rivet, one of whose rivet heads functions as a screw head, while the other rivet head takes over the function of the nut or flat head screw.

The hinge parts can be injection-molded from metal or preferably from plastic. When made of plastic, the catch surfaces offer low coefficients of friction. But it can also be advantageous for higher loading capacity to form the catch surfaces from a metal part which is introduced or injected into the plastic.

It is also possible to construct the hinge pin device from two sleeves which are inserted one inside the other, wherein the outer, first sleeve is fixedly connected (e.g., pressed or glued) with one hinge part, so that this sleeve is not axially displaceable with respect to the hinge in the assembled state. The inner, second sleeve is arranged inside this first, outer sleeve so as to be axially displaceable and rotatable. The outer sleeve can then form one catch surface with an annular shoulder which projects inward radially, while the other inner sleeve forms the corresponding second catch surface rotating on it, wherein this sleeve is suitably connected with the other hinge part so as to be rigid with respect to rotation but displaceable axially. The inner sleeve then receives the spring which presses the catch surfaces of the two sleeves against one another. The spring is penetrated by a retaining pin or retaining rivet, which latter may also be in the shape of a sleeve, as the case may be. This arrangement is particularly stable and makes possible a particularly strong hinge with hinge tabs of plastic in which the sleeves which are made of metal, for example, are embedded.

The invention is commercially applicable in switch cabinet construction.

While the foregoing description and drawings represent the present invention, it will be obvious to those skilled in the art that various changes may be made therein without departing from the true spirit and scope of the present.

What is claimed is:

1. A screw-on hinge for a door or flap which is arranged so as to be swivelable around a hinge-axis vertically or horizontally at a frame or wall, wherein the door or flap is held in releasable manner in at least one swivel angle position, said screw-on hinge comprising:

a first hinge part which can be fastened to the frame;

a second hinge part which can be fastened to the door or flap;

each of said hinge parts being symmetric with respect to a center bisecting line and each of said hinge parts having a bore hole for a hinge pin arrangement;

the hinge pin arrangement comprising:

a first sleeve arrangement connected to the first hinge part so said first sleeve arrangement being not rotatable with respect to said first hinge part;

and a second sleeve arrangement being connected to said second hinge part so said second sleeve arrangement is not rotatable with respect to said second hinge part, said first sleeve arrangement comprising two ends with receiving bores, said second sleeve arrangement comprising two parts being rotatably embraced by the receiving bores, a spring loaded catch device arranged between said first sleeve arrangement and said second sleeve arrangement, wherein the catch device is formed by end faces of the second sleeve arrangement and comprises a helical pressure spring arranged axially inside each of the sleeve arrangements.

2. The screw-on hinge according to claim 1, wherein the non-rotational connection between said first sleeve arrangement and said first hinge part is achieved by a tongue-in-groove arrangement or by a prismatic or non-round cross-sectional shape.

3. The screw-on hinge according to claim 1, wherein said first hinge part encloses the said second hinge part.

4. The screw-on hinge according to claim 1, wherein the two end faces of the second sleeve parts which end faces face one another, are provided with projections or recesses which engage in corresponding recesses and projections formed by annular shoulders in the hinge part bore hole in which the corresponding end faces are received.

5. The screw-on hinge according to claim 4, wherein the other respective end of the hinge pin parts is received in the hinge pin bore hole of the other hinge part so as to be rigid with respect to rotation but so as to slide in axial direction.

6. The screw-on hinge according to claim 1, wherein the ends of the helical pressure springs face away from each other are pressed together by a screw penetrating the spring parts, wherein one spring is supported on the head of the screw and the other spring is supported on a nut which is screwed on.

7. The screw-on hinge according to claim 6, wherein a rivet presses the pressure springs together instead of the screw bolt.

8. The screw-on hinge according to claim 7, wherein the rivet is a hollow rivet.

9. The screw-on hinge according to claim 1, wherein the end faces of the second sleeve arrangement has four projections or recesses having a distance of 90 angular degrees from one another.

10. The screw-on hinge according to claim 1, wherein there are also four recesses or projections formed by the shoulder which have a spacing of 90 angular degrees relative to one another, wherein the 0-degree orientation of the recesses and projections with respect to the fastening surface of the hinge has a displacement of a few degrees.

11. The screw-on hinge according to claim 10, wherein the displacement is about 5°.

12. The screw-on hinge according to claim 10, wherein the orientation of the catch locations is carried out in such a way that this catch position is just reached when the door or flap is in the closed position.

13. The screw-on hinge according to claim 10, wherein the catch device is constructed in such a way that the spring pressure of the helical spring within a small angle of rotation extending around the catch point leads to a torque in the direction of the catch point, and in that the orientation of one catch point for the closing position is carried out in such a way that a torque acting in the closing direction occurs on the door or flap when this door or flap is closed.

14. The screw-on hinge according to claim 1, wherein the hinge parts are constructed in such a way that they can be screwed onto fastening surfaces of the frame and door or flap, which fastening surfaces are flush with one another.

15. The screw-on hinge according to claim 1, wherein the hinge parts are injection molded from plastic.

16. The screw-on hinge according to claim 15, wherein the catch surfaces of the one hinge part are formed from a metal part which is introduced and, in particular, injected, into the plastic.

17. The screw-on hinge according to claim 1, wherein the hinge pin device is formed of a first sleeve which is fixedly connected with one hinge part and a second sleeve which is connected with the other hinge part so as to be rigid with respect to rotation but displaceable axially, wherein the second sleeve is arranged in the first sleeve and the first sleeve forms an annular shoulder with catch devices, which annular shoulder projects inward radially, the end face of the second sleeve rests on these catch devices by a corresponding catch device under spring force which is generated by a helical pressure spring arranged inside the second sleeve.

18. The screw-on hinge according to claim 17, wherein the two sleeves are made of different materials such as metal and plastic.

19. The screw-on hinge according to claim 17, wherein the helical pressure spring(s) is (are) held under tension by a screw bolt or rivet, particularly a hollow rivet.

* * * * *